US008021144B2

(12) United States Patent
Vestin

(10) Patent No.: US 8,021,144 B2
(45) Date of Patent: Sep. 20, 2011

(54) CATALYTIC COMBUSTOR AND METHOD THEREOF

(75) Inventor: Anders Erik Vestin, Malmö (SE)

(73) Assignee: Zemission AB, Lund (SE)

( * ) Notice: Subject to any disclaimer, the term of this patent is extended or adjusted under 35 U.S.C. 154(b) by 664 days.

(21) Appl. No.: 11/994,558

(22) PCT Filed: Jul. 5, 2006

(86) PCT No.: PCT/EP2006/063887

§ 371 (c)(1), (2), (4) Date: Jul. 28, 2008

(87) PCT Pub. No.: WO2007/003649

PCT Pub. Date: Jan. 11, 2007

(65) Prior Publication Data

US 2009/0123885 A1 May 14, 2009

(30) Foreign Application Priority Data

Jul. 5, 2005 (SE) ..... 0501559

(51) Int. Cl.

| | |
|---|---|
| ***F23D 11/44*** | (2006.01) |
| ***F23D 3/40*** | (2006.01) |
| ***F23D 14/12*** | (2006.01) |
| ***F23C 9/00*** | (2006.01) |
| ***F23C 13/04*** | (2006.01) |
| ***F23C 13/02*** | (2006.01) |
| ***F23Q 7/06*** | (2006.01) |

(52) U.S. Cl. ..... 431/208; 431/11; 431/116; 431/258; 431/326; 431/328

(58) Field of Classification Search ..... 431/328, 431/208, 258, 11, 326, 116
See application file for complete search history.

(56) References Cited

U.S. PATENT DOCUMENTS

| | | | | |
|---|---|---|---|---|
| 6,048,198 | A | 4/2000 | Okada et al. | |
| 6,065,957 | A | 5/2000 | Kondo et al. | |
| 6,302,683 | B1 * | 10/2001 | Vestin et al. | 431/7 |
| 6,632,085 | B1 * | 10/2003 | Suzuki et al. | 431/328 |

FOREIGN PATENT DOCUMENTS

| | | |
|---|---|---|
| DE | 195 14 369 | 1/1996 |
| DE | 100 42 479 | 3/2002 |
| EP | 1 126 216 | 8/2001 |
| FR | 623 437 | 1/1926 |

* cited by examiner

*Primary Examiner* — Kenneth B Rinehart
*Assistant Examiner* — William G Corboy, III
(74) *Attorney, Agent, or Firm* — Merchant & Gould P.C.

(57) ABSTRACT

A catalytic combustor (1) is provided for combustion of gaseous and liquid fuels, which combustor comprises a housing (2) having an inlet (3) and an outlet (4) through which an airflow is directed, and a fuel injector (10) for injecting fuel in the airflow. The combustor also comprises at least one catalytic element (12, 14, 15) for combusting the mixture of air and fuel. A fuel-evaporating device (7) is arranged for evaporating a liquid fuel, which device is heated by the catalytic element (12), either through combustion therein or by means of an electrical heating element (13) arranged adjacent thereto.

18 Claims, 1 Drawing Sheet

CATALYTIC COMBUSTOR AND METHOD THEREOF

FIELD OF THE INVENTION

The present invention relates to a catalytic combustor and more specifically to such a combustor for gaseous and liquid fuels. The invention also relates to a method for starting and operating said catalytic combustor.

BACKGROUND OF THE INVENTION

Catalytic combustion in general has many advantages compared to conventional gas phase combustion. The most obvious advantages are the very low emissions, high safety (normally no flame is present and the gas mixture is too lean for gas phase ignition), controllability, wide power range and silent operation. Typical disadvantages are the requirements of complete fuel evaporation and homogenous air/fuel mixture to eliminate the risk for thermal degradation of the catalyst. Due to the fuel evaporation requirement, combustion of gaseous fuels presents fewer challenges than liquid fuel combustion and the commercial applications are increasing. However, when it comes to catalytic combustion of liquid fuels there are still few, if any, commercial applications due to the problem to achieve complete and efficient evaporation of hydrocarbon fuels without accumulation of heavy hydrocarbon residues. Furthermore, there is a need for a fast and low-emission start-up principle for such a process, consuming a minimum of electrical energy.

The problem with evaporation of liquid fuels lies in the fact that the evaporator temperature must be controllable depending on the operating conditions of the burner and accumulation of heavy hydrocarbon residuals must be prevented in order to avoid coking. Furthermore, the evaporator must reach a suitable temperature in short time during start-up in order to obtain a fast and efficient start-up process improving performance and minimizing cold start emissions. Finally, this has to be accomplished with minimal energy consumption.

SUMMARY OF THE INVENTION

The disadvantages of prior art catalytic combustors are overcome by the present invention, having the features as given in the independent claims. Further objects and embodiments are given by their dependent claims.

BRIEF DESCRIPTION OF THE DRAWINGS

A catalytic combustor of the present invention will be more readily understood by reading the below description with reference to the appended drawings, in which.

DETAILED DESCRIPTION OF A PREFERRED EMBODIMENT

Figure 1:
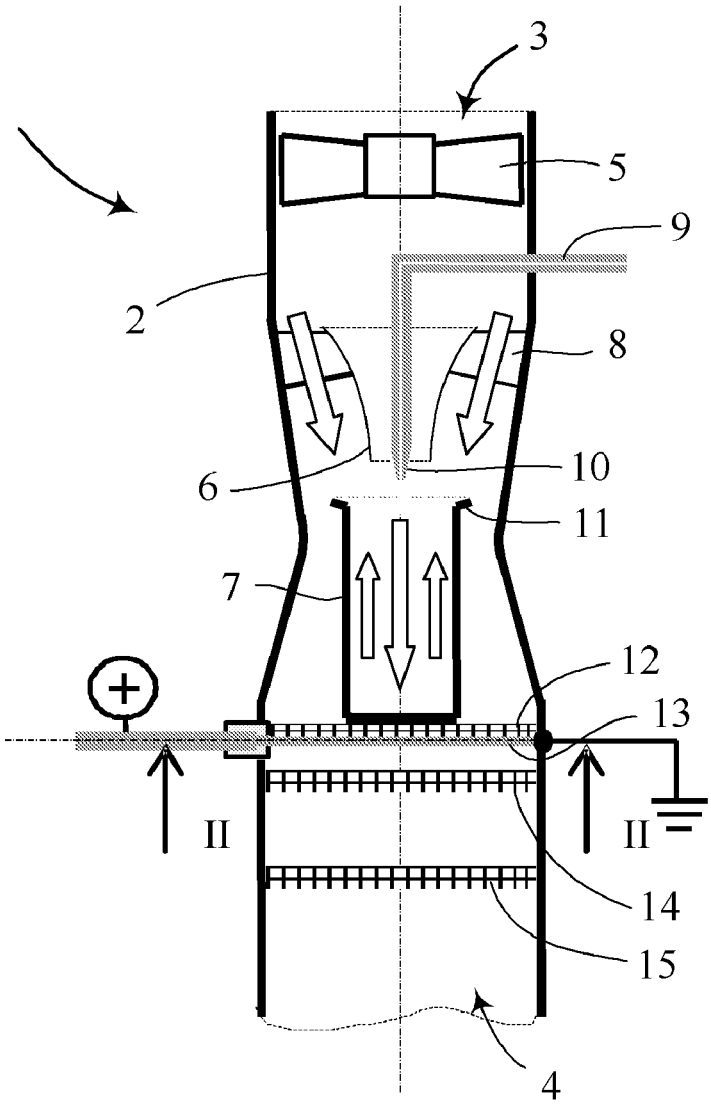
FIG. 1 is a side view in section of the catalytic combustor according to the invention.

A catalytic combustor 1 is shown in section in FIG. 1. The combustor comprises a generally cylindrical outer housing 2, forming a venturi in the mid-section, and the housing has an inlet 3 at one end and an outlet 4 at the other end. A fan 5 is provided at the inlet 3, for supplying the combustor 1 with air, and the air is partly directed into a gradually contracted channel 6, leading to a fuel-evaporating device 7. Another part of the airflow is led outside the channel 6, where the air passes swirl vanes 8, located at an inlet to the venturi. A fuel supply pipe 9 enters the housing upstream of the channel 6, and the pipe is provided with a nozzle 10, which can be a simple orifice, for injecting liquid fuel from just below or inside the channel 6 and into the fuel-evaporating device 7. The nozzle 10 is located in the middle of the airflow running through the channel 6. The fuel-evaporating device 7 is equipped with an outwardly extending edge 11 at its upper perimeter, where the air and fuel mixture radially outwards and upwards exits the fuel-evaporating device 7. The diameter or cross-sectional area of the fuel-evaporating device 7 may be substantially constant, as shown in FIG. 1, or increase towards the inlet of the combustor. The upper part, as seen in the Figure, of the fuel-evaporating device 7 having the edge 11, is located at the venturi contraction and the bottom part thereof is located at the outlet of the venturi.

Figure 2:
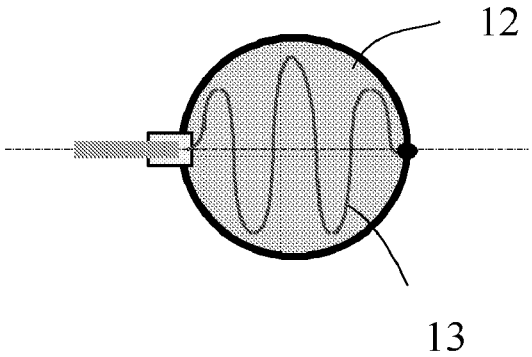
FIG. 2 is a section along the line II-II of an electrical heating device having an electrical heating element being placed adjacent to a catalytic element.

A first catalytic element 12 is located slightly downstream of the venturi, and said element 12 is provided with an electrical heating element 13, either in close proximity to the catalytic element 12 or in direct contact therewith. Depending on the desired steady state operating temperature of 12, the electrical heating element can be located either upstream or downstream of 12. Second 14 and third 15 catalytic elements are located further downstream in the housing 2. The catalytic elements 12, 14, 15 are formed with a metallic or ceramic support covered by a ceramic washcoat being catalytically active, or is coated with a catalytically active phase. If the support of the first catalytic element 12 is made of metal, this support can be used as the electrical heating element 13 by using the electrical resistance of said support. The housing 2 has a generally circular cross-section, which can be seen in FIG. 2 showing a sectional view at II-II, but this is not essential.

The electrical heating element 13 and the first catalytic element 12 can be seen from below in FIG. 2. The electrical heating element 13 may be electrically insulated from the first catalytic element 12 by the washcoat and/or a ceramic substrate of the first catalytic element 12.

Operation of the Catalytic Combustor

During steady-state operation, the fan 5 supplies air from an atmosphere into the inlet 3 of the combustor 1. A central part of the airflow enters the gradually contracting channel 6, where the velocity of the airflow increases. Liquid fuel is injected by a low-pressure pump or by gravity from the fuel nozzle 10 in the center of the central airflow and the fuel and air flows downwards into the fuel-evaporating device 7 until it hits the bottom thereof. The fuel-evaporating device 7 is heated by the combustion in the first catalytic element 12, or (directly or indirectly) by the electrical heating element 13 during startup. At the bottom, the flow is reversed and instead flows upwards along the inside wall of the fuel-evaporating device 7 until it exits over its edge 11 and continues radially upwards and outwards. This gas path ensures substantial preheating of the air during steady state operation but also directly in the start up phase. Furthermore, it extends the total mixing length of the vaporized fuel and the air. An outer part of the airflow from the inlet 3 flows on the outside of the central channel 6 and passes the swirl vanes 8. These vanes impart a swirling motion to the airflow as it continues into the contraction of the venturi. Additionally, the swirl induces a pressure drop which accelerates the airflow through the central channel 6. The two flows are mixed radially outside of the fuel-evaporating device 7 and continue together downstream towards the first catalytic element 12. The mixing is enhanced by the swirling motion of the second airflow and by small-scale turbulence, which is generated at the edge 11 of the fuel-evaporating device 7. The outer part of the flow is slightly preheated mainly by convection at the combustor walls. However it can be beneficial with further preheating of this flow before mixing with the central air flow. This can be achieved by, for example, leading the flow in a concentrically shaped channel around the outer housing 2. The fuel and air mixture is at least partly combusted in the first catalytic element 12, and additional combustion can take place in downstream catalytic elements 14 and 15, depending on the operating conditions of the combustor 1.

In an embodiment, the fuel is supplied through the fuel nozzle 10 as droplets that are carried by gravity and the airflow towards the bottom of the fuel-evaporating device 7. The pulsating fuel flow will give an increased oxygen penetration creating an oxidizing effect that will prevent heavy fractions of the fuel from coking in the fuel-evaporating device 7. The simple dripping fuel nozzle or injector is further much easier to service and will be much cheaper to manufacture. There is no need for a fuel pump, which further reduces the cost of an assembled unit.

The temporal fluctuations in the air/fuel ratio that result from the intermittent dripping of the liquid fuel will probably be insignificant, due to residence time given by the mixing volume between the fuel-evaporating device 7 and the catalytic element 12 and the vigorous mixing by the large and small scale turbulence at the outlet from the fuel-evaporating device 7. Small fluctuations will have little impact on the combustion, since catalysts normally have a memory effect, i.e. thermal inertia and an oxygen storage capacity, and hence are more dependent on the average air/fuel ratio as opposed to a normal flame.

The combustor is designed with security measures in order to prevent occurrence of backfire. Backfires result if the combustion taking place in one of the catalytic elements is carried upstream towards the fuel evaporating device 7. This is prevented in different ways, which are described below. A first safety feature is the small distance between the venturi contraction and the edge 11 of the fuel-evaporating device 7, forming a slit. If this distance is small enough, i.e. close to the quenching distance, it will prevent an accidental flame from traveling upstream the combustor 1. This distance depends on the specific fuel, but is almost constant for most hydrocarbon fuels, about 1.5-2.5 mm. A second safety feature is introduced by the fan 5 in that the flow rate through the combustor is greater than the current flame speed. The flame speed is inter alia given by the laminar flame speed, the air/fuel ratio and the turbulence, and this could be determined for several different operating conditions. Another safety feature comes from the fact that the cell density/mesh number of the catalytic elements is high enough, i.e. the size of their holes small enough, for a flame to be quenched. This means that a catalytically initiated flame is unable to propagate upstream through the catalytic elements 12, 14 and 15 thus acting as flame arresters.

The fuel-evaporating device 7 is heated by the combustion taking place in the first catalytic element 12 and to a lesser extent by the other catalytic elements 14 and 15. The temperature of the fuel-evaporating device should be kept at a suitable level, and this is achieved in different ways by using the specific characteristics of catalytic combustion.

In a first case, the wide range of air/fuel ratios of catalytic combustion is used. If the airflow is increased through the combustor without increasing the fuel flow, this will result in a cooling of the first catalytic element 12 due to the increased mass flow and reduced air/fuel ratio. The temperature is increased if the airflow is instead decreased while keeping the fuel flow substantially constant, thus enabling control of the temperature without changing the power output of the combustor. This is not possible with a flame since it will lead to instability and ultimately flame extinction at lean conditions. In a second case, the temperature can also be reduced by increasing the overall flow rate, without changing the air/fuel ratio. This will lead to incomplete combustion at the first catalytic element 12 and subsequent combustion at the second 14 and third catalytic elements 15. This feature is not obtainable with a normal flame, since it will lead to blow off. Hence, this will also lead to an increased mass flow past the first catalytic element 12, and the unburned fuel and air will not transfer heat to the fuel-evaporating device 7. An increase in temperature will result from a decreased mass flow that leads to a more complete combustion (see further detailed description below). By choosing either of these techniques, depending on the operating condition, the temperature of the fuel-evaporating device 7 can be controlled to a suitable level for each operating condition leading to efficient evaporation of any fuel. This results in a pronounced multi-fuel capability.

At low loads, the reaction zone of the combustion is mainly located in the first catalytic element 12. This increases the temperature of the fuel-evaporating device 7, which enables evaporation of possible accumulated hydrocarbon residue in said fuel-evaporating device 7. At high loads, the gas flow is increased and the mass transfer of reactants to the surface of the catalytic element 12 is enhanced. If all reactants reaching said catalytic element 12 are converted, the power developed in the catalytic element 12 increases. However, at a certain flow, the "blow-out mass flow", all reactants that reach the surface cannot be converted due to a limited chemical reaction rate. The excess reactants in the gas will instead cool the surface of the catalytic element 12, which leads to lowered temperature and a consequent reduction in chemical reaction rate and energy conversion in the catalytic element 12. The excess reactants will be combusted in the downstream located catalytic element(s) 14, 15, if present. This will gradually move the reaction zone downstream, which at high loads essentially will be located at the second catalytic element 14. This will reduce the evaporation temperature of the fuel-evaporating device 7 and also reduce the thermal stress on the electrical heating element 13, such that the evaporator is suited for continuous evaporation of the fuel.

The catalytic combustion can be maintained with high efficiency and subsequent low emissions in a wide range of air/fuel ratios (for this application, the interval is approx. $1.2<\lambda<4$). By changing the airflow at a constant load, the location and temperature of the combustion zone can be adjusted to a position creating a suitable temperature interval for the fuel-evaporating device 7 for efficient evaporation of any fuel. The location of the combustion zone is mainly governed by the flow rate and the temperature is mainly governed by $\lambda$. However, the heat transfer to the fuel-evaporating device 7 is dependent on both the temperature and location of the combustion zone and the temperature of the fuel-evaporating device 7 is additionally dependent on the heat transfer to the incoming air and to the fuel during evaporation.

At startup, only the small first catalytic element 12 and the bottom of the fuel-evaporating device 7 are heated electrically. The temperature of the fuel-evaporating device 7 is so low that only the light fractions of the fuel are evaporated. Hence, the fuel vapour reaching the catalytic element will initially mainly contain light fuel fractions, which enables a fast and low emission light-off in the first catalytic element 12. After light-off, the temperature in the fuel-evaporating device 7 increases rapidly, allowing for the evaporation of the heavier fractions of the fuel and subsequent combustion in the catalytic element 12. This process gives a fast and clean startup with completely vaporized fuel at a minimal consumption of electrical energy. Furthermore, the risk of thermal degradation of the catalyst is limited, due to the complete fuel evaporation.

The above techniques for controlling the temperature of the fuel-evaporating device 7 gives the combustor a pronounced multi-fuel capability, since the evaporation temperature can be adapted for fuels having different heat of vaporization and different vaporization temperatures. The combustor can have different settings depending on which fuel is used, with regards to air/fuel ratio, total mass flow at a given power etc.

The combustor described above is easily started since the first catalytic element 12 is provided with an electrical heating element 13, which initially will bring the temperature in the first catalytic element 12 to a light-off temperature and promote evaporation of mainly light fractions in the adjacent fuel-evaporating device 7. The electrical heating element can then be switched off and the fuel-evaporating device is heated by the combustion in the catalytic element 12. The heavier fractions will then be evaporated gradually, during warm-up of the combustor towards steady state operation.

If there are large spatial variations in the air/fuel ratio, this may lead to hot spots, which in turn lead to thermal degradation of the catalytic element(s). This can be avoided by thorough mixing upstream of the catalytic elements, e.g. by using a swirl as mentioned above.

ALTERNATIVE EMBODIMENTS

The combustor of the invention does not have to be formed with a venturi in the midsection. The main purpose of the venturi is to ensure a sufficiently small distance at the outlet of the fuel-evaporating device for quenching an accidental flame and for ensuring thorough mixing at said outlet of the fuel and air. The expansion of the venturi further leads to a large area of the catalytic elements, which allows for large power of the combustor. These features can be accomplished in other ways, as is clear to a person skilled in the art. The housing can instead be formed with an expanding portion, having a first and second transition where the housing, having substantially parallel walls, connects to the expanding portion.

The fuel-evaporating device 7 is illustrated with substantially parallel walls, but this is not necessary for carrying out the invention. The walls of the fuel-evaporating device 7 may just as well be angled outwards in the direction towards the inlet of the combustor, e.g. 5-45 degrees. This will have some impact on the flow inside the fuel-evaporating device 7 and also on its outside.

The catalytic combustor of the invention is described as being axial, but can just as well have a radial configuration. In this case, the catalytic elements 12, 13, 14 can be arranged concentrically, with the first catalytic element 12 being placed in the middle. The fuel-evaporating device 7 should in this case be placed inside the first catalytic element 12 in a similar way as described above.

The fuel-evaporating device 7 could be designed as a centrally located tube, in which fuel and air is injected. The tube can in this case be provided with shelves or protrusions on its inside wall, where the injected liquid fuel could be maintained during evaporation. Alternatively, the fuel-evaporating device can be supplied with air at, or in close proximity to, its bottom through a channel essentially located at the middle of the housing. Additionally, this inlet can be directed tangentially with the inner surface of the fuel-evaporating device 7, generating a swirl to further enhance the mixing and preheating inside the fuel-evaporating device 7 and to enhance the oxygen supply to the bottom surface of the fuel-evaporating device 7. A swirl inside the fuel-evaporating device 7 can also be generated by, for example, swirl vanes. All or only a part of the air of the combustor 1 can be supplied at the bottom of the fuel-evaporating device 7. The air can then be added through a tube that surrounds the fuel tube. If the airflow is directed tantentially towards the inner surface or wall of the fuel-evaporating device 7, also the fuel will be directed tangentially to that wall.

In applications where electricity is unavailable, it would be beneficial if the combustor were self-sustaining. This can be achieved by promoting natural ventilation through the combustor, e.g. by having the inlet at the bottom and arranging the fuel-evaporating device 7 to accept fuel from the top. A fuel tank should be located higher than the fuel injector 10 and the electrical heating element 13 be replaced with e.g. an annular wick, situated upstream the catalytic element 12, which wick is supplied fuel from a separate fuel line. By lighting the wick, the catalytic element 12 is brought to its light-off temperature and the fuel-evaporating device 7 is heated sufficiently for some of the heavy fractions to evaporate. The flame on the wick will burn out soon after the catalytic element 12 has ignited.

A more advanced combustor embodiment is possible inside a vehicle, where both electricity and electronics are available for powering and controlling the combustor. In this case, sensors can be used for determining air and fuel flow and the fan 5 can be electrically powered. The fuel injector 10 can be supplied fuel from a pump.

The advantages of a catalytic combustor are its low emissions of unburned hydrocarbons and carbon monoxide, due to the relatively high reaction rate at lean air/fuel ratios, and nitrogen oxides due to the low combustion temperature, well below the temperature where the Zeldovich mechanism begins to have a significant impact on NOx formation, typically 1800 K. The high reaction rate and thermal inertia also makes the combustion more stable at lean operating conditions compared to a flame at similar conditions.

The present invention can be used for many different applications where multi-fuel, catalytic combustion is desirable, such as in vehicle heaters, heat-powered refrigerators and air conditioners, thermoelectric generators, ovens, cooking stoves, heating of exhaust cleaning systems, in small-scale gas turbines and stirling engines.

Even though the present invention has been described as a detailed example, it will be evident to a person skilled in the art to make modifications without departing from the scope of the invention as defined by the appended claims.

The invention claimed is:

1. A catalytic combustor for liquid and gaseous fuels comprising a housing having an inlet and an outlet through which an airflow is directed, a fuel injector injecting fuel in said airflow, at least one catalytic element having a support and a catalytically active surface, and a fuel-evaporating device wherein an electrical heating element is provided for simultaneously heating the fuel-evaporating device and the at least one catalytic element, wherein the housing is formed with an expanding portion having a first and second transition and an outlet from the fuel-evaporating device is located in close vicinity to the first transition of the expanding portion of the housing.

2. A catalytic combustor according to claim 1, wherein a metal support of the catalytic element forms the electrical heating element.

3. A catalytic combustor according to claim 1, wherein the catalytic element is heated by combustion of a mixture of the fuel and air.

4. A catalytic combustor according to claim 1, wherein the electrical heating element is arranged in close proximity to or in direct contact with the first catalytic element.

5. A catalytic combustor according to claim 1, wherein the fuel-evaporating device is located in close proximity to or in direct contact with the first catalytic element.

6. A catalytic combustor according to claim 1, wherein the inlet is equipped with a swirl generating device for imparting a swirling motion to at least a part of the inlet flow.

7. A catalytic combustor according to claim 1, wherein the fuel-evaporating device is formed with walls, or a cylindrical wall, extending substantially upstream.

8. A catalytic combustor according to claim 1, wherein the fuel is injected by the fuel nozzle as droplets that are carried by gravity and the central airflow into the fuel-evaporating device.

9. A catalytic combustor according to claim 1, wherein the housing is formed with a venturi or an expanding portion between the inlet and the outlet.

10. A method for controlling a catalytic combustor according to claim 1, comprising a step of regulating the airflow rate through the combustor in order to control the downstream location dz of maximum heat release dQ in said at least one catalytic element, in order to accurately control the temperature of the fuel-evaporating device.

11. A method according to claim 10, wherein the overall flow rate of air and fuel through the combustor is regulated at a level where incomplete combustion occurs in the first catalytic element, while keeping the average air/fuel ratio substantially constant, for regulating the temperature of the fuel-evaporating device.

12. A method according to claim 10, wherein the mixture of fuel and air is discharged from the fuel- evaporating device into a second airflow and is mixed prior to being combusted in the catalytic element.

13. A method according to claim 10, wherein at least a part of the airflow is directed towards a heated surface of the fuel-evaporating device, so that oxidation of heavy residuals thereon can take place.

14. A method according to claim 10, wherein subsequent combustion takes place in at least one additional catalytic element downstream of said catalytic element.

15. A method according to claim 10, wherein subsequent combustion takes place in a catalytically initiated flame downstream of said catalytic element.

16. A method according to claim 10, wherein a bottom of the fuel-evaporating device is heated.

17. A method according to claim 10, wherein the fuel-evaporating device is electrically heated either directly or via said catalytic element.

18. A method of starting a catalytic combustor according to claim 1, comprising steps of simultaneously electrically heating the first catalytic element and the fuel-evaporating device, injecting a fuel having lighter and optionally heavier fractions into the fuel-evaporating device, combusting the lighter fractions of the fuel in the first catalytic element, such that both the fuel-evaporating device and the first catalytic element is heated by the heat from the catalytic combustion to an operating temperature of the combustor where any optional heavy fractions of the fuel can be evaporated in the fuel-evaporating device.

* * * * *